United States Patent [19]

Kraus

[11] Patent Number: 4,575,910

[45] Date of Patent: Mar. 18, 1986

[54] METHOD OF TREATING TRACTION SURFACES

[75] Inventor: Charles E. Kraus, Austin, Tex.

[73] Assignee: Excelermatic Inc., Austin, Tex.

[21] Appl. No.: 721,992

[22] Filed: Apr. 11, 1985

[51] Int. Cl.[4] ..... B21H 1/14

[52] U.S. Cl. ..... 29/148.4 D; 72/53; 72/365

[58] Field of Search ..... 72/53, 365, 366, 102; 29/148.4 D, 90 B, 159.2

[56] References Cited

U.S. PATENT DOCUMENTS 4,167,864 9/1979 Taipale ..... 72/53

4,408,473 10/1983 Bassoff ..... 72/102

FOREIGN PATENT DOCUMENTS 660762 5/1979 U.S.S.R. ..... 72/102

*Primary Examiner*—Lowell A. Larson

*Assistant Examiner*—David B. Jones

[57] ABSTRACT

In a method of treating the traction surfaces of traction roller transmissions having traction elements the traction elements are supported with their traction surfaces in engagement with one another and relative motion is provided between the traction elements at surface speeds of 200–750 inch/minute while a load of 3 to 5 times the basic dynamic surface contact pressure to the traction elements is applied whereby surface asperities are forced into the surface and eliminated while any minute surface depressions remain, thereby providing traction surfaces with excellent traction properties and good wear resistance.

2 Claims, No Drawings

METHOD OF TREATING TRACTION SURFACES

BACKGROUND OF THE INVENTION

The invention relates to a method of treating the traction surfaces of traction roller transmissions.

Traction roller surfaces of traction roller transmissions, especially those with V groove traction surfaces, require a very high degree of dimensional accuracy. The V-grooved rollers as described in the inventor's copending U.S. application Ser. No. 699,835, which is assigned to the assignee of the present invention, must have perfectly accurate spacing of the side walls with accurate angles in order to meet the contact areas uniformly from groove to groove and also across the contact areas. With today's sophisticated tools it is possible to grind to almost any accuracy and small errors can still be corrected by honing and lapping processes, but these processes are very expensive when extremely high accuracy is required.

It is therefore the object of the present invention to provide a surface finishing method which is inexpensive and does not require highly sophisticated tools and yet which provides the surface dimensional and smoothness accuracies as they are required for traction roller transmissions with V groove traction surfaces.

SUMMARY OF THE INVENTION

In order to provide the desired surface accuracy, the transmission with the traction surfaces of the rollers and rings in engagement with one another is operated slowly under a heavy surface load such that the surface contact pressures exceed the yield strength even of hardened steel.

With this method, surface unevenness of the conical traction surfaces, however slight, is smoothed out simply by forcing the protruding areas into the surface since, in the protruding areas the surface pressure greatly amplified exceeds yield strength of the material.

Preferably, the rolling speed is 30–120 rpm, that is, for a 2 inch diameter roller about 200–750 inches/minute, and the surface pressure is about 3 to 5 times the basic dynamic design surface contact pressure assuming that the traction surfaces are evenly loaded.

In practice, the traction surfaces which, after being ground to a size as desired, are grit and/or glass beaded and have small protruding asperities and minute depressions. When subjected to high pressure rolling in accordance with the invention, the traction surface asperities which are undesirable are eliminated but the depressions which are desirable remain.

The method according to the invention therefore provides traction surfaces with characteristics which make them particularly suitable for use in the traction rollers providing for good traction properties and good wear resistance.

I claim:

1. A method of treating the traction surfaces of traction roller transmissions having rotatable traction elements, with circular traction surfaces comprising the steps of: supporting the traction elements with their traction surfaces in engagement with one another rotating the traction elements so as to provide traction surface speeds of about 200–750 inch/minute, and applying a load of 3 to 5 times the basic dynamic surface contact design pressure to the traction elements whereby, at surface asperities the surface pressure is amplified and exceeds the yield strength of the traction element surface material, such that the asperities are forced into the traction surfaces and eliminated while any minute surface depressions remain.

2. A method according to claim 1, wherein the traction surfaces are first grit beaded to provide said asperities and depressions before they are subjected to the pressure rolling step.

* * * * *